US009050236B2

(12) United States Patent
Kudoh

(10) Patent No.: US 9,050,236 B2
(45) Date of Patent: Jun. 9, 2015

(54) WALKING ASSISTANCE DEVICE

(75) Inventor: Hiroshi Kudoh, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 439 days.

(21) Appl. No.: 13/112,348

(22) Filed: May 20, 2011

(65) Prior Publication Data

US 2011/0288454 A1 Nov. 24, 2011

(30) Foreign Application Priority Data

May 24, 2010 (JP) ..... 2010-118298

(51) Int. Cl.
*A61H 3/00* (2006.01)
*A61H 1/02* (2006.01)

(52) U.S. Cl.
CPC ..... *A61H 3/00* (2013.01); *A61H 1/024* (2013.01); *A61H 2201/0103* (2013.01); *A61H 2201/1215* (2013.01); *A61H 2201/1633* (2013.01); *A61H 2201/1642* (2013.01); *A61H 2201/1647* (2013.01); *A61H 2201/165* (2013.01); *A61H 2201/1676* (2013.01)

(58) Field of Classification Search
CPC ..... A61H 1/024; A61H 2201/0103; A61H 2201/0149; A61H 2201/1215; A61H 2201/1633; A61H 2201/1642; A61H 2201/1647; A61H 2201/1676; A61H 2201/165
USPC ..... 601/23, 27, 33, 34, 35; 297/199, 200, 297/201, 204, 215.13, 215.14, 195.11, 297/452.17; 5/709, 655.4
See application file for complete search history.

(56) References Cited

U.S. PATENT DOCUMENTS

| | | | | | |
|---|---|---|---|---|---|
| 484,367 | A | * | 10/1892 | Hicks | 297/1 |
| 623,505 | A | * | 4/1899 | Avery | 297/207 |
| 3,758,153 | A | * | 9/1973 | Bonikowsky | 297/199 |
| 3,796,460 | A | * | 3/1974 | Potchen | 297/211 |
| 4,114,214 | A | * | 9/1978 | VonHeck | 297/284.1 |
| 4,611,851 | A | * | 9/1986 | Noyes et al. | 297/199 |
| 4,673,216 | A | * | 6/1987 | Alfer | 297/452.27 |

(Continued)

FOREIGN PATENT DOCUMENTS

| | | |
|---|---|---|
| JP | 62-128984 | 8/1987 |
| JP | 3-42793 | 4/1991 |

(Continued)

OTHER PUBLICATIONS

Japanese Office action dated Dec. 24, 2013, English translation included.

*Primary Examiner* — Justine Yu
*Assistant Examiner* — Timothy Stanis
(74) *Attorney, Agent, or Firm* — Rankin, Hill & Clark LLP

(57) ABSTRACT

A walking assistance device includes a seating member configured to provide seating for a user; and leg links connected to the seating member. The seating member includes: a seating frame having at least two frames movably connected to each other; a bag member secured to the seating frame; filler contained in the bag member and freely movable in the bag member; and a valve provided on the bag member and capable of switching between a first state in which an inside of the bag member is in communication with an outside of the bag member and a second state in which the communication between the inside and the outside of the bag member is interrupted.

22 Claims, 6 Drawing Sheets

(56) References Cited

U.S. PATENT DOCUMENTS

| | | | | |
|---|---|---|---|---|
| 5,009,318 | A * | 4/1991 | Lepinoy | 206/524.8 |
| 5,074,618 | A * | 12/1991 | Ballard | 297/199 |
| 5,121,962 | A * | 6/1992 | Weber et al. | 297/214 |
| 5,203,606 | A * | 4/1993 | Granzotto | 297/201 |
| 5,244,251 | A * | 9/1993 | Bourla | 297/199 |
| 5,280,993 | A * | 1/1994 | Hsh | 297/199 |
| 5,286,082 | A * | 2/1994 | Hanson | 297/201 |
| 5,368,358 | A * | 11/1994 | Christensen | 297/215 |
| 5,769,488 | A * | 6/1998 | Daniels et al. | 297/199 |
| 5,945,571 | A * | 8/1999 | Pinkos et al. | 568/865 |
| 6,135,550 | A * | 10/2000 | Tucho | 297/199 |
| 6,226,820 | B1 * | 5/2001 | Navarro | 5/655.5 |
| 6,254,180 | B1 * | 7/2001 | Nelson | 297/201 |
| 6,260,919 | B1 * | 7/2001 | Yates | 297/215 |
| 6,827,397 | B1 | 12/2004 | Driver | |
| 7,500,717 | B2 * | 3/2009 | Bigolin | 297/201 |
| 7,628,451 | B2 * | 12/2009 | Chuang | 297/201 |
| 8,394,044 | B2 | 3/2013 | Ashihara et al. | |
| 2006/0270951 | A1 * | 11/2006 | Ikeuchi | 601/5 |
| 2008/0265635 | A1 * | 10/2008 | Scheffer et al. | 297/201 |
| 2010/0063424 | A1 | 3/2010 | Kudoh et al. | |
| 2010/0069799 | A1 | 3/2010 | Ashihara et al. | |

FOREIGN PATENT DOCUMENTS

| | | |
|---|---|---|
| JP | 10-071055 | 3/1998 |
| JP | 2008-48753 | 3/2008 |
| JP | 2008-048754 | 3/2008 |

* cited by examiner

WALKING ASSISTANCE DEVICE

CROSS REFERENCE TO RELATED APPLICATION

This application claims the foreign priority benefit under Title 35, United States Code, §119(a)-(d) of Japanese Patent Application No. 2010-118298 filed on May 24, 2010 in the Japan Patent Office, the disclosure of which is herein incorporated by reference in its entirety.

BACKGROUND OF THE INVENTION

1. Technical Field

The present invention relates to a walking assistance device having a saddle (i.e., seating member) on which a user can sit.

2. Description of the Related Art

For example, a conventional body weight support-type walking assistance device is disclosed in Japanese Laid-open Patent Application Publication No. 2008-48753. This walking assistance device includes a saddle on which a user sits, leg links each extending downward from and rotatably connected to the saddle to allow swing movements thereof in synchronous with movements of joints in the user's legs, and shoe-like foot attachment portions each provided at the lower end of the leg link.

In order to prevent the saddle from being displaced forward or backward relative to buttocks of the user, the saddle of this walking assistance device is specially-shaped to have front and rear ends extending upward. This unique shape allows the saddle to be fitted to the buttocks of the user and stably support the body of the user.

However, because of this unique shape of the saddle, if the walking assistance device is used among a group of users who have totally different physiques, it is necessary to provide a plurality of different types of saddles for different physiques of individual users, and whenever users with different physiques use the walking assistance device, the saddle has to be replaced with another one.

In view of the above disadvantage of the conventional walking assistance device, it would be desirable to provide a walking assistance device of which a saddle (i.e., seating member) can fit each individual user without replacement of the saddle in cases where one walking assistance device is used among a group of users who have totally different physiques.

SUMMARY OF THE INVENTION

According to one aspect of the present invention, there is provided a walking assistance device comprising a seating member configured to provide seating for a user; and leg links connected to the seating member. The seating member comprises a seating frame having at least two frames movably connected to each other, a bag member secured to the seating frame, filler contained in the bag member and freely movable in the bag member, and a valve provided on the bag member and capable of switching between a first state in which an inside of the bag member is in communication with an outside of the bag member and a second state in which the communication between the inside and the outside of the bag member is interrupted.

With this configuration of the walking assistance device, after the user sits on the seating member, air in the bag member may be discharged through the valve. This allows the filler in the bag member to be contoured to fit a body shape of a user and compacted (become substantially unmovable). If another user uses the walking assistance device, air is supplied into the bag member so that the filler can be moved in the bag member, and thereafter the user carries out the above operation to allow the bag member to fit his body shape.

Therefore, if the walking assistance device is used among a group of users who have totally different physiques, the seating member can be contoured to fit individual users without replacement of the seating member.

In the aforementioned walking assistance device, the bag member may be configured to cover connecting portions at which the frames constituting the seating frame are connected.

With this configuration, since the bag member covers the connecting portions of the frames, when air is discharged from the bag member, particles or aggregates of the filler contact with each other and movements of the filler are restricted, so that the connecting portions between the frames are pressed and fixed by the filler. In the case where another user uses the walking assistance device, air is supplied into the bag member, and thereafter each frame is moved in accordance with the body shape of the latter user and the air in the bag member is discharged. The frames can be fixed by this simple operation without requiring fixing members such as bolts.

In the aforementioned walking assistance device, the frames may be connected to allow forward and backward movements thereof.

With this configuration, since the frames are relatively movable in the front-back direction, different physiques among the users in the front-back direction can be absorbed.

Further, in the aforementioned walking assistance device, at least two bag members may be provided, and filler made of a different material may be contained in one bag member. As one specific embodiment, three bag members may be provided, and each of the bag members may be filed with filler made of a different material.

With this configuration, various kinds of filler can be selected; for example, filler in a bag member that is arranged in a position corresponding to the user's ischial bone is made of a material harder than those of the fillers in the other bag members. The seating member can better support the user by selecting fillers conforming to a part of the user's physique.

BRIEF DESCRIPTION OF THE DRAWINGS

Other objects and aspects of the present invention will become more apparent by describing in detail illustrative, non-limiting embodiments thereof with reference to the accompanying drawings, in which.

DETAILED DESCRIPTION OF THE INVENTION

With reference to the attached drawings, a walking assistance device according to one exemplary embodiment of the present invention will be described.

Figure 1:
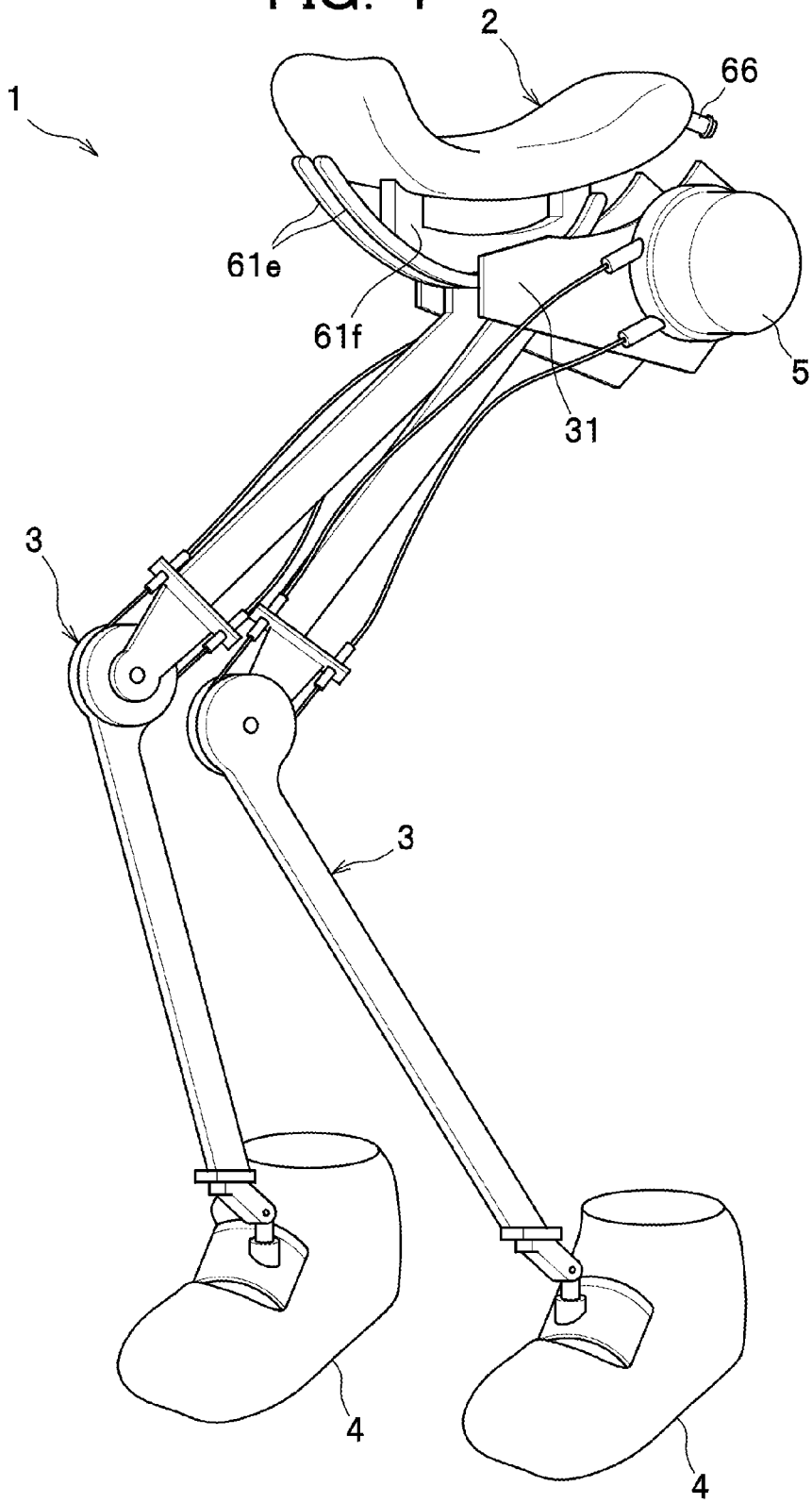
FIG. 1 is a perspective view showing a walking assistance device according to one exemplary embodiment of the present invention.

As seen in FIG. 1, the walking assistance device 1 includes a seating member 2 configured to provide seating for a user, a pair of leg links 3 connected to the seating member 2, shoe-like members 4 provided at lower ends of the leg links 3, and a pair of motors 5 for driving the respective leg links 3. When the walking assistance device 1 is used, the user sits on the seating member 2 while putting his feet into the shoe-like members 4.

Figure 2A:
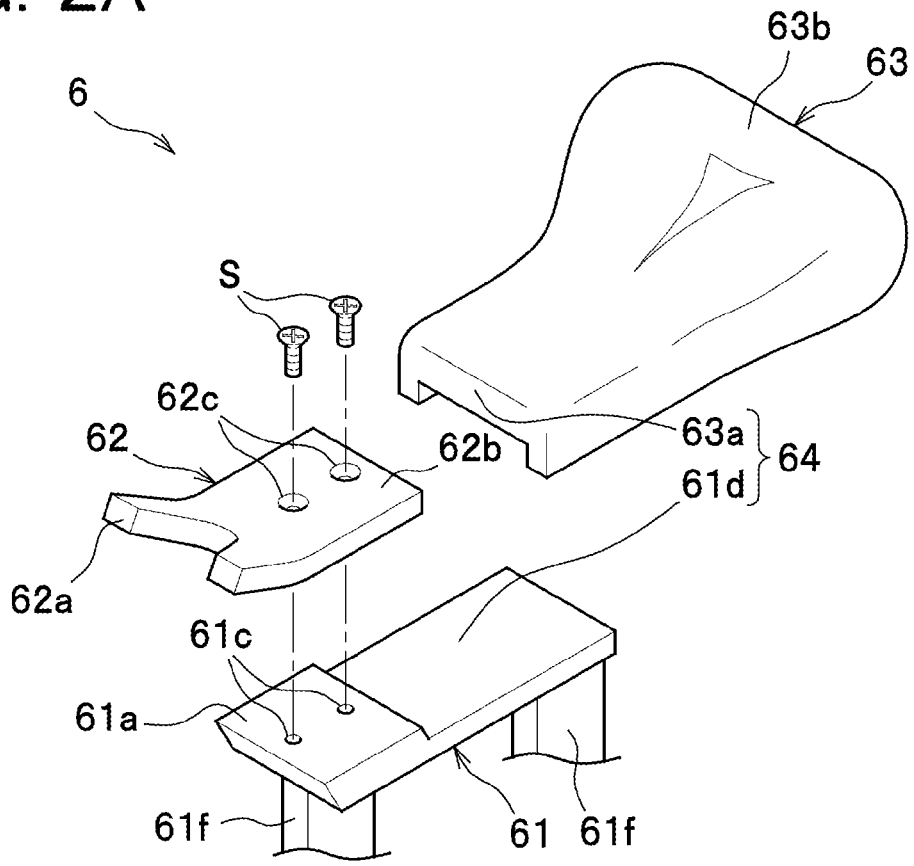
FIG. 2A is an exploded perspective view of a seating frame.
Figure 3:
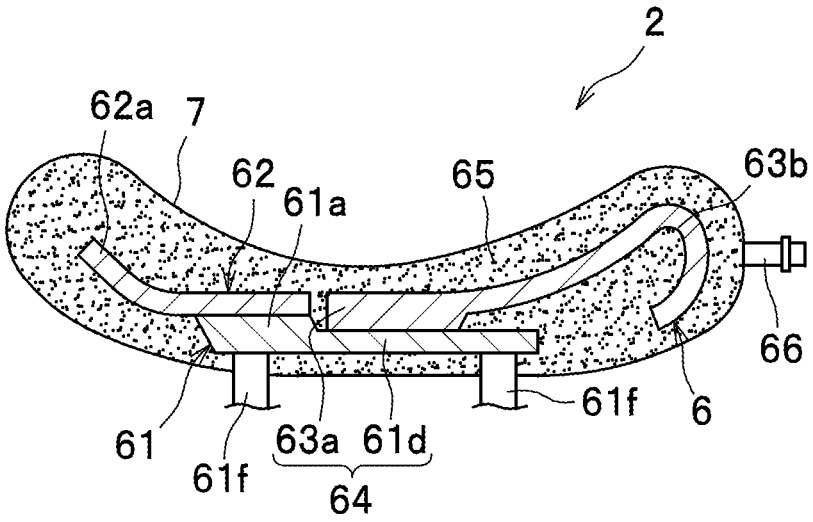
FIG. 3 is an explanatory view illustrating a seating member.

As best seen in FIGS. 2A and 3, the seating member 2 mainly consists of a seating frame 6 and a bag member 7 configured to cover the seating frame 6.

As seen in FIG. 2A, the seating frame 6 has a base frame 61, a front-side frame 62 fixed to a front end 61*a* of the base frame 61, a rear-side frame 63 disposed at the rear of the front-side frame 62 and slidably mounted to the base frame 61 to allow forward and backward movements of the rear-side frame 63 relative to the base frame 61.

The base frame 61 is a plate-like frame having a front end portion 61*a* which is thicker than the remaining portion (e.g., base portion 61*d*). A stepped portion is formed at a boundary between the front end portion 61*a* and the remaining portion. This stepped portion serves to prevent the rear-side frame 63 from moving too much in the forward direction and coming off from the base frame 61.

Two screw holes 61*c* into which screws S can be threadedly engaged are formed in an upper surface of the front end portion 61*a*. These screw holes 61*c* are spaced apart from each other and arranged in line in the front-back direction.

The base frame 61 has a base portion 61*d* extending at a level one step lower than the front end portion 61*a*. The base portion 61 is shaped like a plate extending substantially horizontally in the front-back direction, and the rear-side frame 63 is slidably mounted on the base portion 61*a*, so that the rear-side frame 63 is slidable in the front-back direction relative to the base portion 61.

As best seen in FIG. 1, a pair of arcuate rail portions 61*e* are fixed to the under surface of the base frame 61 through connecting members 61*f*. Each rail portion 61*e* is rotatably supported on a supporting member 31 provided at an upper side of the leg link 3 so that forward and backward movements of the seating member 2 along the rail portions 61*e* can be performed. Accordingly, the seating member 2 can be supported on the leg links 3 in a stable posture without staggering in the front-back direction.

As seen in FIG. 2A, the front-side frame 62 is shaped like a plate extending substantially horizontally in the front-back direction and has a bifurcated front end portion 62*a* which is curved upward. Providing the front end portion 62*a* can prevent the seating member 2 from being displaced backward relative to and coming off from the inguinal region of the user.

The substantially horizontally extending plate-like portion of the front-side frame 62 forms a planer portion 62*b*. Two screw insertion holes 62*c* for inserting screws S are formed in the planer portion 62*b*. The screw insertion holes 62*c* are spaced apart from each other and arranged in line in the front-back direction such that the positions of the screw insertion holes 62*c* are aligned with those of the screw holes 61*c*. The front-side frame 62 can be fixed to the base frame 61 by the screws S.

The rear-side frame 63 has a front end portion 63*a* which is formed to have an inverted U-shaped cross-section whose lower side is open. The rear-side frame 63 is slidably mounted on the base portion 61*d* of the base frame 61. In other words, the base frame 61 and the rear-side frame 63 are movably connected to each other with the base portion 61*d* and the front end portion 63*a* acting as a connecting portion 64. Sliding the rear-side frame 63 forward or backward relative to the base frame 61 allows the front-back length of the seating member 2 to be adjusted in accordance with different physiques of the users.

Figure 2B:
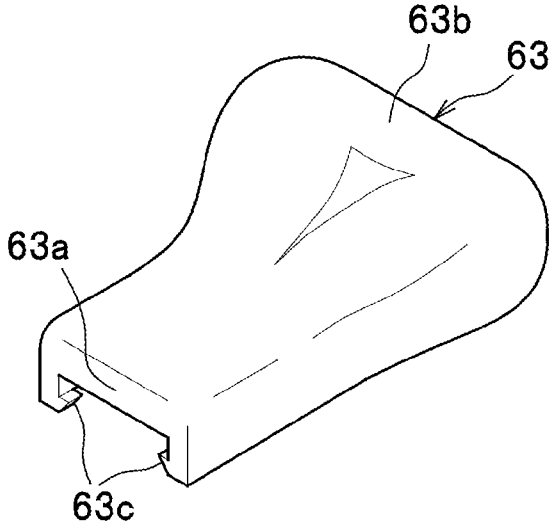
FIG. 2B is a perspective view showing a modification of a rear-side frame.

As best seen in FIG. 2B, it is preferable that claws 63*c* project inward from the right and left bottom end portions of the U-shaped front end portion 63*a* of the rear-side frame 63. Since the claws 63*c* can be engaged with the underside of the base frame 61, it is possible to prevent the rear-side frame 63 from being disengaged in the upward direction from the base frame 61.

Further, a rear end portion 63*b* of the rear-side frame 63 is curved upward and has a width (i.e., length in the right-left direction) broader than that of the front end portion 63*a*. Providing the rear end portion 63*b* can prevent the seating member 2 from being displaced forward relative to and coming off from the buttocks of the user.

As seen in FIG. 3, the bag member 7 is configured to cover the seating frame 6 (particularly the connecting portion 64 of the base frame 61 and the rear-side frame 63), and styrene beads 65 as an example of filler are contained in the bag member 7. The bag member 7 has a valve 66 capable of switching between a first state in which the inside of the bag member 7 is in communication with the outside of the bag member 7 and a second state in which the communication between the inside and the outside of the bag member 7 is interrupted.

To be more specific, the bag member 7 is joined to the seating frame 6 (e.g., connecting members 61*f*), where necessary, so as to allow the entrance of air into the bag member 7 only through the valve 66. A fine-mesh filter (not shown) which can inhibit the passage of the styrene beads 65 (i.e., mesh size is smaller than the diameter of the styrene bead 65) is provided in the valve 66. The fine-mesh filter may be provided to surround an area where the valve 66 is connected to the bag member 7.

Next, operation and advantageous effects of the seating member 2 according to this embodiment will be described.

Figure 4A:
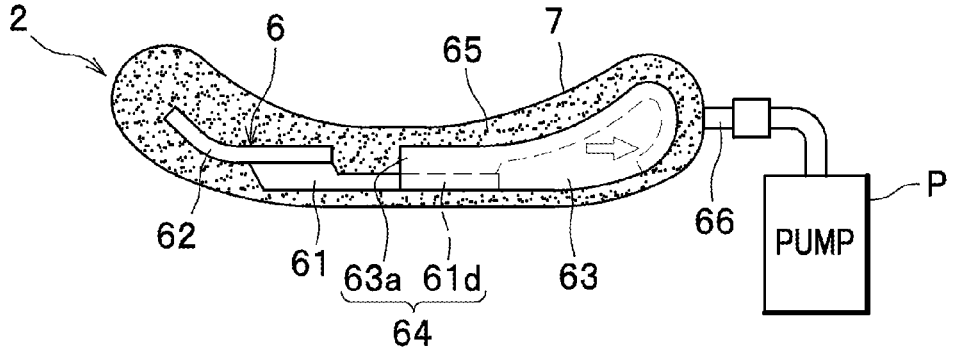
FIGS. 4A to 4C explain the manner of use of the seating member.

As best seen in FIG. 4A, if a certain amount of air is supplied into the bag member 7, the styrene beads 65 are freely movable in the bag member 7. Before seating on the seating member 2, the user first connects a pump P to the valve 66 and moves the rear-side frame 63 forward or backward relative to the base frame 61 to thereby perform a coarse adjustment for adjusting the front-back length of the seating frame 6 in accordance with the user's body shape.

In this exemplary embodiment, the pump P is provided as a separate equipment independent of the walking assistance device 1. However, the present invention is not limited to this specific configuration, and the pump P may be integrally provided on the walking assistance device 1.

Figure 4B:
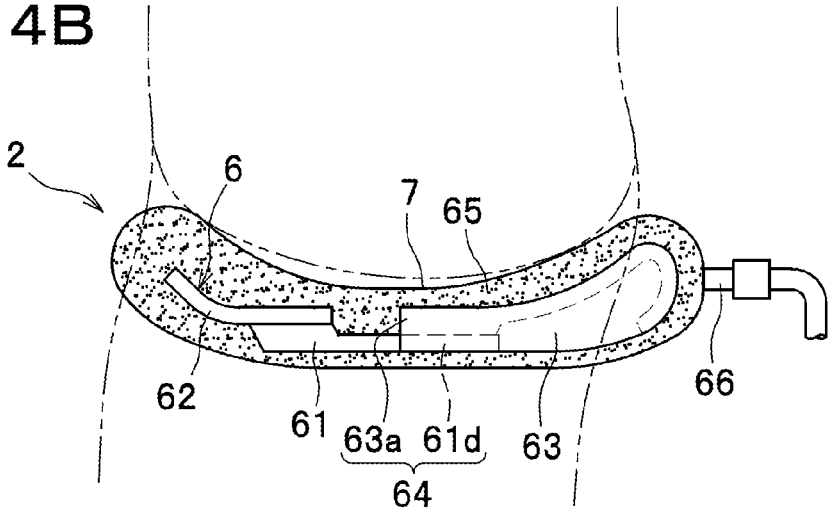
Figure 4C:
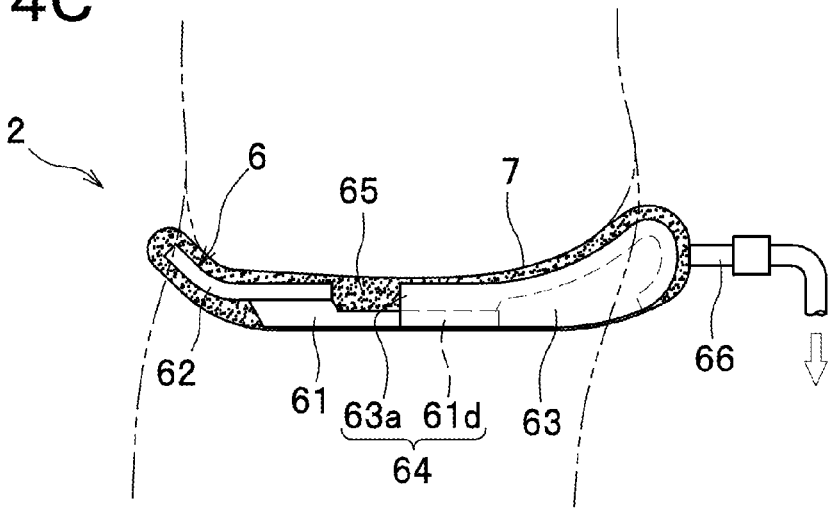

After approximately determining the front-back length of the seating frame 6, the user sits astride on the seating member 2 as best seen in FIG. 4B. If the front-back length of the seating member 6 determined by the coarse adjustment does not fit the user, he can perform a fine adjustment by slightly moving the rear-side frame 63 forward or backward relative to the base frame 61. The user then opens the valve 66 and causes the air in the bag member 7 to be discharged by the pump P. As best seen in FIG. 4C, the styrene beads 65 in the bag member 7 come into fit with the body shape of the user with the gradual discharge of the air from the bag member 7. When the aggregation of the styrene beads 65 fits the body shape of the user and is compacted, the styrene beads 65 become substantially unmovable.

Accordingly, the shape of the seating member 2 is best fitted to the user. The user then closes the valve 66 and removes the pump P from the valve 66. The walking assistance device 1 is thereby ready for comfortable use.

Further, the connecting portion 64 between the base frame 61 and the rear-side frame 63 which are covered with the bag member 7 is tightened up by the bag member 7 with the discharge of the air from the bag member 7. By this tightening force, the base frame 61 and the rear-side frame 63 can be closely contacted at the connecting portion 64. According to this configuration of the seating member 2, the base frame 61 and the rear-side frame 63 can be fixed at the connecting portion 64 by a simple operation without requiring fixing members such as bolts.

If the walking assistance device 1 is used by another user, the valve 66 is open so that air is supplied into the deflated bag member 7 shown in FIG. 4C and the styrene beads 65 are allowed to be sufficiently movable in the bag member 7. Thereafter, the latter user repeats the aforementioned operation and causes the bag member 7 to be best fitted to the body shape of the latter user.

Therefore, even if the walking assistance device 1 is used among a group of users who have totally different physiques, the seating member 2 can be contoured to fit individual users without replacement of the seating member 2.

Although the present invention has been described in detail with reference to the above exemplary embodiment, the present invention is not limited to this specific embodiment and various changes and modifications may be made without departing from the scope of the appended claims. In the drawings to be referred to in the following description, parts similar to those previously described in the above embodiment are denoted by the same reference numerals and detailed description thereof will be omitted.

In the above exemplary embodiment, the walking assistance device 1 has only one bag member. However, the present invention is not limited to this specific embodiment, and a plurality of bag members may be employed. In this instance, at least one bag member may contain filler made of a different material.

Figure 5:
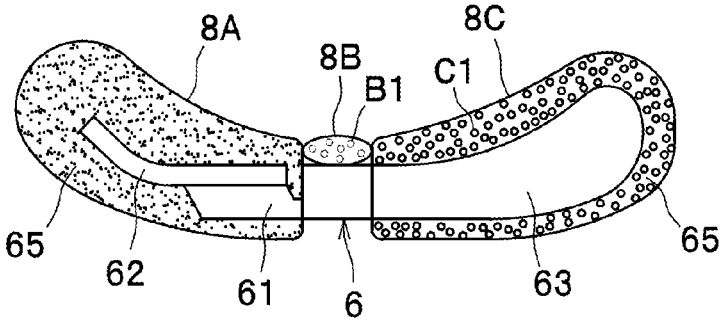
FIG. 5 shows a modified embodiment in which the seating member has a plurality of bag members.

For example, as seen in FIG. 5, three bag members 8A, 8B, 8C may be provided on the seating frame 6. It is preferable that the front bag member 8A contains filler made of styrene beads 65 as with the above exemplary embodiment, the middle bag member 8B contains filler made of a material B1 softer than the styrene beads 65, and the rear bag member 8C contains filler made of a material C1 harder than the styrene beads 65. Namely, materials of the fillers in the three bag members 8A, 8B, 8C are selected such that the filler in the rear bag member 8C is the hardest of all, the filler in the front bag member 8A is the second hardest, and the filler in the middle bag member 8B is the softest.

According to this modified embodiment, the filler in the bag member 8C disposed at the rear part (i.e., region extending from the center to the rear end) of the rear-side frame 63 by which the user's ischial bone is supported is made of a material harder than those of the other bag members 8A, 8B. This makes it possible to comfortably support the ischial bone of the user by the bag member 8C containing the filler of a hard material. Further, the filler in the bag member 8A by which the user's inguinal region is supported is made of a material softer than that of the bag member 8C, so that the inguinal region of the user can be protected by the bag member 8A.

However, unlike the above embodiment as shown in FIG. 5, in which hardness of the bag members 8A, 8B, 8C is varied by changing the material of the filler in each bag member, the hardness of the bag members may be varied, for example, by changing the amount of air discharged from each bag member.

In the case where a plurality of bag members are separately provided, each bag member may have a valve. However, in the case where one bag member is divided into a plurality of regions by partitions having fine air holes, only one valve may be provided for these regions.

Figure 6A:
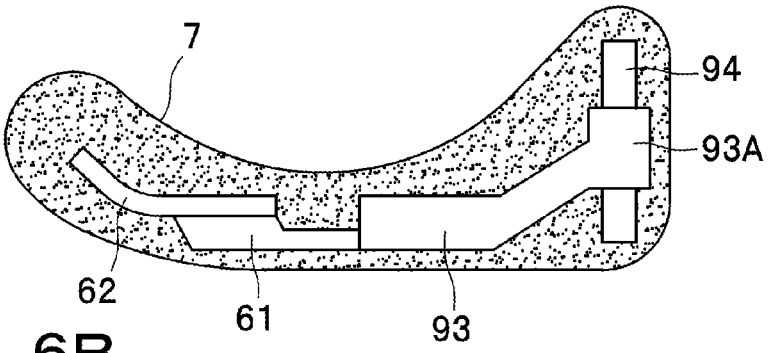
FIGS. 6A and 6B show another modified embodiment of the seating frame.
Figure 6B:
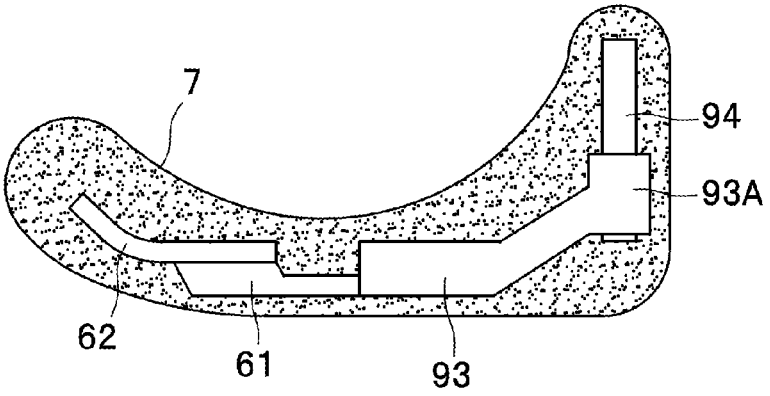

In the above exemplary embodiment, two frames 61, 63 are movably connected to allow forward and backward movements thereof. However, the present invention is not limited to this specific configuration, and the frames may be connected to allow right and left movements or upward and downward movements thereof. In one example, as best seen in FIGS. 6A and 6B, there may be provided a back frame 94 which is movable in the vertical direction relative to the rear-side frame 93.

Even in this modified embodiment, if the bag member 7 is provided to cover the connecting portion 93A of the rear-side frame 93 slidably contacting the back frame 94, the styrene beads 65 in the bag member 7 come into fit with the body shape of the user with the gradual discharge of the air from the bag member 7. When the aggregation of the styrene beads 65 fits the body shape of the user and is compacted, the styrene beads 65 become substantially unmovable around the connecting portion 93A. Therefore, the back frame 94 can be fixed to the vertical position conforming to the physique of the user.

Figure 7:
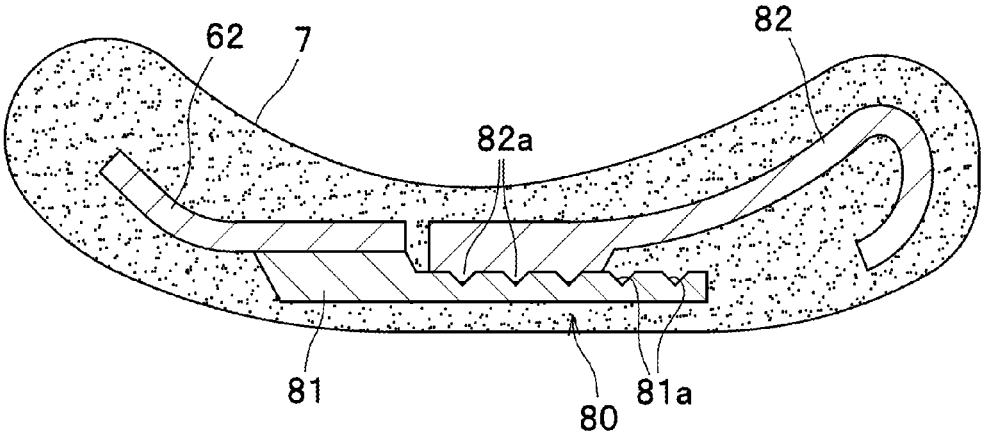
FIG. 7 is a further modified embodiment in which the seating frame has a corrugated frictional engagement mechanism.

In the above exemplary embodiment and this modified embodiment, the connecting portion 93A and the connecting portion 64 are configured such that flat surfaces are slidably engaged with each other. However, the present invention is not limited to this specific configuration. For example, as best seen in FIG. 7, two slidably engaged members 81, 82 may be provided such that one member 81 has a plurality of recesses 81*a* arranged in a direction along which the frames can slide and constituting a corrugated surface and the other member 82 has one or more nail portions 82*a* urged toward and engageable with one of the plurality of recesses 81*a*. With this configuration, since the nail portions 82*a* are engagable with the recesses 81*a*, a shift of the frames in the sliding direction can be restricted as compared with the above exemplary embodiment.

In the above embodiments, the seating frame 6 consists of three frames. However, the present invention is not limited to this specific configuration as long as the seating frame consists of at least two frames.

In the above embodiments, the filler is made of styrene beads 65. However, the present invention is not limited to this specific configuration, and other materials such as feather and cotton may be used as the filler.

Further, in the above embodiments, the manually operable valve 66 is employed. However, the present invention is not limited to this specific valve, and there may be used a one way valve which is opened when it is pressed by the air discharged from the bag member (e.g., valve integrally and swingably provided in a tubular discharge port and sized to close the discharge port). In this embodiment, when the bag member is pressed down by the weight of the user, the valve opens and the air in the bag member can be discharged. If the walking assistance device is used by another user, the user pinches the tubular discharge port between his fingers to open the valve. The user then blows into the air intake port or inflates the bag member using a manually operable inflator.

What is claimed is:

1. A walking assistance device comprising:

a seating member configured to provide seating for a user; and leg links connected to the seating member, wherein the seating member comprises:

a seating frame having at least two frames movably connected to each other;

a bag member secured to the seating frame;

the bag member including an inflatable portion;

filler contained in the bag member and freely movable in the bag member; and a valve provided on the bag member and capable of switching between a first state in which an inside of the inflatable portion of the bag member is in communication with an outside of the inflatable portion of the bag member and a second state in which the communication between the inside and the outside of the inflatable portion of the bag member is interrupted, wherein a connecting portion at which the at least two frames are connected is disposed inside the inflatable portion of the bag member.

2. The walking assistance device according to claim 1, wherein the inflatable portion of the bag member includes a first bag member provided at a forward part of the seating frame and adapted to support an inguinal region of the user, and a second bag member provided at a backward part of the seating frame and adapted to support an ischial bone of the user, the filler includes a first filler contained in the first bag member and a second filler contained in the second bag member, and the second filler is made of material that is harder than material from which the first filler is made.

3. The walking assistance device according to claim 1, wherein the inflatable portion of the bag member includes a first bag member provided at a forward part of the seating frame and adapted to support an inguinal region of the user, a second bag member provided at a backward part of the seating frame and adapted to support an ischial bone of the user, and a third bag member provided at a central part of the seating frame between the first bag member and the second bag member, the filler includes a first filler contained in the first bag member, a second filler contained in the second bag member, and a third filler contained in the third bag member, and the second filler is made of material that is harder than material from which the first filler is made, and the first filler is made of material that is harder than the material from which the third filler is made.

4. The walking assistance device according to claim 1, wherein at least one of the frames is disposed inside the inflatable portion of the bag member.

5. The walking assistance device according to claim 1, wherein the inflatable portion of the bag member is at least partially located on an upper side of the seating frame, and the seating member is configured for the user to directly sit on the inflatable portion of the bag member.

6. The walking assistance device according to claim 1, wherein the filler is granular and the filler is aggregated and compacted when the walking assistance device is used.

7. The walking assistance device according to claim 6, wherein the filler is styrene beads.

8. The walking assistance device according to claim 1, wherein the inflatable portion of the bag member is switchable between an inflated state and a deflated state by operation of the valve, and wherein the bag member and filler are configured to exert a tightening force on the connecting portion of the seating frame when the bag member is in the deflated state, the tightening force fixing the at least two frames relative to each other.

9. The walking assistance device according to claim 1, wherein the seating frame has at least a first frame slidably connected to a second frame at the connecting portion, wherein the first frame is slidably connected to the second frame to be slidable in a forward and backward direction relative to the second frame, and sliding the first frame in the forward and backward direction relative to the second frame adjusts a length of the seating member in the forward and backward direction, wherein the inflatable portion of the bag member is switchable between an inflated state and a deflated state by operation of the valve, and wherein the bag member and filler are configured to exert a tightening force on the connecting portion of the seating frame when the bag member is in the deflated state, the tightening force holding the first frame in a fixed slidable position in the forward and backward direction relative to the second frame.

10. A walking assistance device comprising:

a seating member configured to provide seating for a user; and leg links connected to the seating member, wherein the seating member comprises:

a seating frame having at least a first frame slidably connected to a second frame;

a bag member secured to the seating frame, the bag member including an inflatable portion in which at least a portion of the seating frame is disposed;

filler contained in the bag member and freely movable in the bag member; and a valve provided on the bag member and capable of switching between a first state in which an inside of the bag member is in communication with an outside of the bag member and a second state in which the communication between the inside and the outside of the bag member is interrupted, wherein a connecting portion at which the at least two frames are connected is disposed inside the bag member, and wherein the first frame is slidably connected to the second frame to be slidable in a forward and backward direction relative to the second frame, and sliding the first frame in the forward and backward direction relative to the second frame adjusts a length of the seating member in the forward and backward direction.

11. The walking assistance device according to claim 10, wherein the inflatable portion of the bag member includes a first bag member provided at a forward part of the seating frame in the forward and backward direction and adapted to support an inguinal region of the user, and a second bag member provided at a backward part of the seating frame in the forward and backward direction and adapted to support an ischial bone of the user, the filler includes a first filler contained in the first bag member and a second filler contained in the second bag member, and the second filler is made of material that is harder than material from which the first filler is made.

12. The walking assistance device according to claim 11, wherein the inflatable portion of the bag member includes a first bag member provided at a forward part of the seating frame in the forward and backward direction and adapted to support an inguinal region of the user, a second bag member provided at a backward part of the seating frame in the forward and backward direction and adapted to support an ischial bone of the user, and a third bag member provided at a central part of the seating frame between the first bag member and the second bag member, the filler includes a first filler contained in the first bag member, a second filler contained in the second bag member, and a third filler contained in the third bag member, and the second filler is made of a material that is harder than material from which the first filler is made, and the first filler is made of material that is harder than the material from which the third filler is made.

13. The walking assistance device according to claim 10, wherein at least one of the frames is disposed inside the bag member.

14. The walking assistance device according to claim 10, wherein the bag member is located on an outermost side of the seating member such that the user directly sits on the bag member.

15. The walking assistance device according to claim 10, wherein the filler is granular and the filler is aggregated and compacted when the walking assistance device is used.

16. The walking assistance device according to claim 15, wherein the filler is styrene beads.

17. The walking assistance device according to claim 10, wherein the seating frame is disposed inside the bag member.

18. The walking assistance device according to claim 10, wherein the second frame has an upwardly facing plane and the first frame has a downwardly facing plane which is slidable in the forward and backward direction relative to the upwardly facing plane of the second frame.

19. A walking assistance device comprising:

a seating member configured to provide seating for a user; and leg links connected to the seating member, wherein the seating member comprises:

a seating frame having at least two frames movably connected to each other;

a bag member secured to the seating frame;

the bag member including an inflatable portion;

filler contained in the bag member and freely movable in the bag member; and a valve provided on the bag member and capable of switching between a first state in which an inside of the inflatable portion of the bag member is in communication with an outside of the inflatable portion of the bag member and a second state in which the communication between the inside and the outside of the inflatable portion of the bag member is interrupted, wherein the seating frame is disposed inside the inflatable portion of the bag member, wherein the inflatable portion of the bag member is switchable between an inflated state and a deflated state, and wherein the bag member and filler are configured to exert a tightening force on the seating frame when the bag member is in the deflated state, the tightening force fixing the at least two frames relative to each other.

20. The walking assistance device according to claim 19, wherein the inflatable portion of bag member is located on an outermost side of the seating member such that the user directly sits on the inflatable portion of the bag member.

21. The walking assistance device according to claim 19, wherein the filler is granular and the filler is aggregated and compacted when the walking assistance device is used.

22. The walking assistance device according to claim 21, wherein the filler is styrene beads.

* * * * *